US005915627A

United States Patent [19]

Plasko

[11] Patent Number: 5,915,627

[45] **Date of Patent: *Jun. 29, 1999**

[54] METHOD AND APPARATUS FOR SPATTERING MASSES

[75] Inventor: Phil Plasko, Glendale, Ariz.

[73] Assignee: Wagner Spray Tech Corporation, Minneapolis, Minn.

[ * ] Notice: This patent is subject to a terminal disclaimer.

[21] Appl. No.: 09/140,714

[22] Filed: Aug. 26, 1998

Related U.S. Application Data

[63] Continuation of application No. 08/667,755, Jun. 21, 1996, Pat. No. 5,842,642.

[51] Int. Cl.[6] ..... B05B 3/08

[52] U.S. Cl. ..... 239/220; 239/215

[58] Field of Search ..... 239/215, 219, 239/220

[56] References Cited

U.S. PATENT DOCUMENTS 629,513 7/1899 Liebscher ..... 239/220

FOREIGN PATENT DOCUMENTS 627480 9/1961 Canada ..... 239/220

*Primary Examiner*—J. Casimer Jacyna

*Attorney, Agent, or Firm*—Parsons & Goltry; Michael W. Goltry; Robert A. Parsons

[57] ABSTRACT

A system for applying a viscous mass upon a surface comprising a housing having a spout and a reservoir for carrying the viscous mass, an abutment spaced from the reservoir, and an impeller rotatably mounted proximate the reservoir having radially extending substantially flexible impeller elements for passing through and collecting the viscous mass upon rotation of the impeller, and for successively engaging the abutment past which the impeller elements are flexed, whereupon release therefrom impel mass particles through the spout against the surface, the abutment being selectively positionable for impelling the viscous mass in a predetermined trajectory.

8 Claims, 4 Drawing Sheets

METHOD AND APPARATUS FOR SPATTERING MASSES

This application is a continuation of U.S. application Ser. No. 08/667,755, filed Jun. 21, 1996, now U.S. Pat. No. 5,842,642.

BACKGROUND OF THE INVENTION

1. Field of the Invention

This invention relates to devices for applying material to a surface.

More particularly, this invention relates to devices for applying viscous masses to a surface.

In a further and more specific aspect, the instant invention relates to a hand held device for impelling a viscous mass in a predetermined trajectory for adherence to a surface.

2. Prior Art

The prior art is replete with apparatus and techniques for applying paint, plaster, and other viscous masses to a surface for adherence thereto. Coatings of a selected viscous mass can be sprayed onto a surface with the use of a spray gun, or applied directly with the use of brushes, rollers, and other similar devices. Viscous masses may further be applied to a surface using a technique commonly referred to as spattering. Spattering involves agitating flexible elements such as bristles or the like for impelling or otherwise catapulting droplets of viscous mass from a viscous mass source for application to a surface. Although the prior art provides apparatus that incorporate spattering as a means for applying a viscous mass to a surface, these apparatus have structural and functional shortcomings necessitating new and useful improvements.

For instance, the prior art has devised many devices that incorporate merely centrifugal force for throwing viscous masses or the like from the tips of bristles and other similar substantially flexible elements. The difficulty with these devices is that they are not very efficient, they do not efficiently throw the viscous mass in an orderly and predictable direction, and do not apply the viscous material evenly, with some areas being more heavily laden with viscous material than others.

One notable device incorporates a reservoir for holding viscous masses and a carrier rotatably mounted proximate the reservoir having flexible elements. The carrier is rotated for passing the flexible elements through the viscous mass, which then successively spatter the viscous mass after contacting an abutment. Although this device is exemplary, it spatters the viscous mass in only one direction, and fails to provide for the efficient and orderly spattering of masses having different viscosity.

It would be highly advantageous, therefore, to remedy the foregoing and other deficiencies inherent in the prior art.

Accordingly, it is an object of the present invention to provide a new and improved applicator for applying viscous masses to a surface.

Another object of the present invention is to provide a new and improved applicator that is easy to construct.

And another object of the present invention is to provide a new and improved applicator that is inexpensive to manufacture.

Still another object of the present invention is to provide a new and improved applicator operative for efficiently spattering viscous masses having different viscosity.

Yet another object of the instant invention is to provide a new and improved applicator for spattering masses in a predetermined trajectory.

Yet still another object of the instant invention is to provide a new and improved applicator that is easy to use.

And a further object of the invention is to provide a new and improved applicator that is easy to clean.

Still a further object of the immediate invention is to provide a new and improved applicator that may be configured for applying a viscous mass to a substantially vertical surface and a substantial horizontal surface, such as a ceiling.

Yet a further object of the invention is to provide a new and improved method of spattering viscous masses to a surface.

And still a further object of the invention is to provide a new and improved applicator that may be used for painting a surface and for applying texture to a surface.

And yet still a further object of the invention is to provide a new and improved applicator selectively adjustable for dispensing a selected quantity of viscous mass.

SUMMARY OF THE INVENTION

Briefly, to achieve the desired objects of the instant invention in accordance with a preferred embodiment thereof, provided is a system for applying a viscous mass upon a surface. The system includes a housing having a spout and a reservoir for carrying the viscous mass. Further included is an abutment spaced from the reservoir, and an impeller rotatably mounted proximate the reservoir having radially extending substantially flexible impeller elements for passing through and collecting the viscous mass upon rotation of the impeller, and for successively engaging the abutment past which the impeller elements are flexed, whereupon release therefrom impel mass particles through the spout against the surface. The abutment is selectively positionable for allowing a user to impel the viscous mass in a predetermined trajectory through the spout. The system herein discussed may further be provided as a hand held applicator for spattering a viscous mass in a predetermined trajectory, and may further include a wiper abutment selectively positionable for controlling the amount of viscous mass impelled or spattered from the spout.

Next provided is a method of applying a viscous mass to a surface. The method includes the steps of providing a reservoir having a spout, the reservoir for carrying the viscous mass, and impelling the viscous mass in a predetermined trajectory.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which.

DETAILED DESCRIPTION OF THE PREFERRED EMBODIMENT

Figure 1:
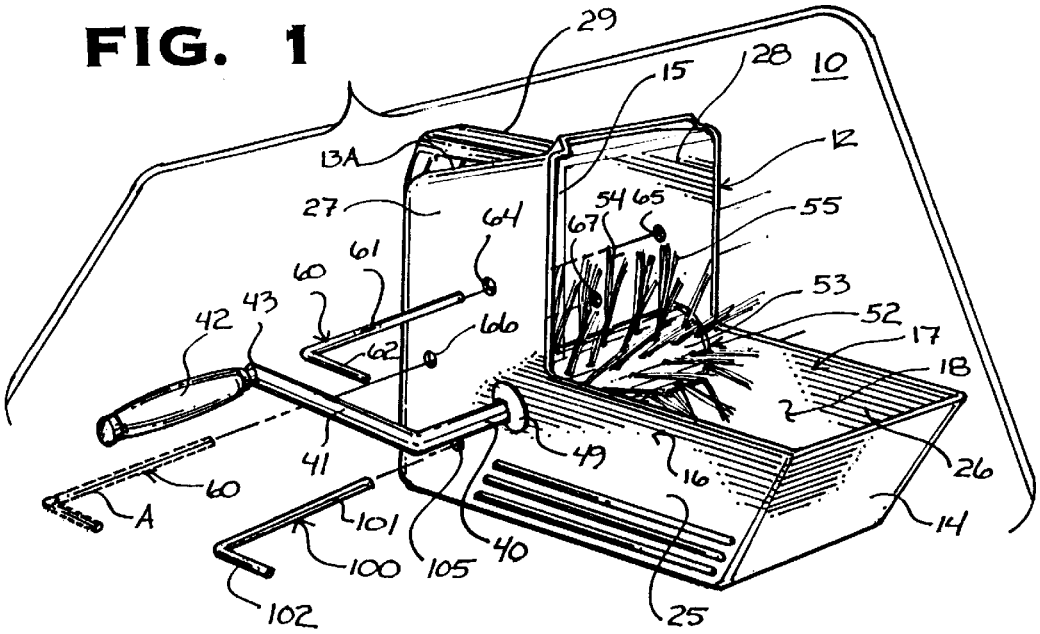
FIG. 1 is a partial exploded perspective view of an applicator for spattering a selected viscous mass constructed in accordance with the preferred embodiment.

Turning now to the drawings, in which like reference characters indicate corresponding elements throughout the several views, attention is first directed to FIG. 1 which illustrates a preferred embodiment of the instant invention comprising an applicator being generally designated by the reference character 10. With respect to the teachings disclosed herein, applicator 10 is operative for distributing or otherwise spattering a viscous mass such as paint, plaster, a selected adhesive, or other such mass, in a predetermined and selected direction for adherence to a selected surface. Additionally, applicator 10 includes desirable and advantageous structural attributes allowing a user to spatter a selected mass for adherence to a substantially horizontal surface such as a ceiling, and a substantially vertical surface such as a wall, without having to aim or otherwise tilt applicator 10, further details of which will be herein discussed as the detailed description ensues.

Figure 2:
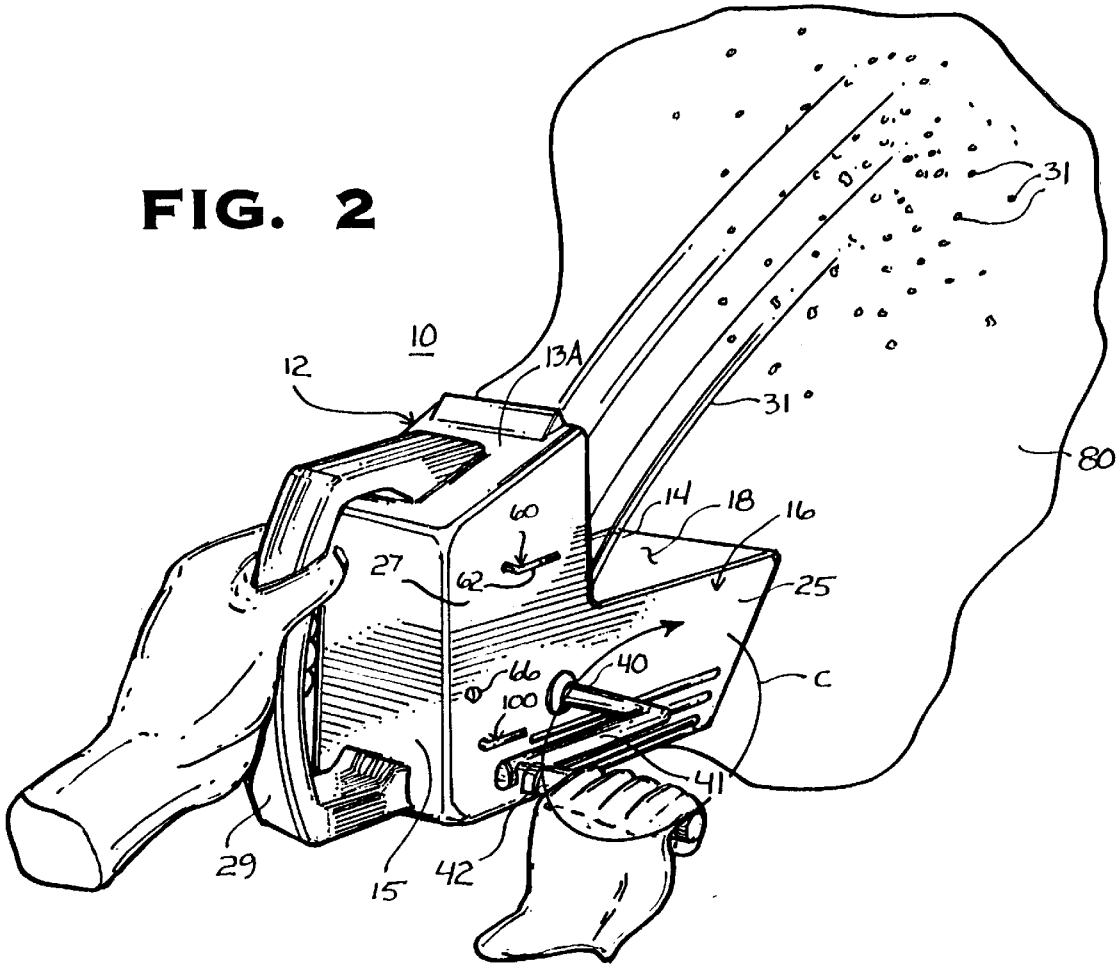
FIG. 2 is a perspective view of the applicator shown as it would appear in use for spattering a viscous mass onto a substantially vertical surface.
Figure 3:
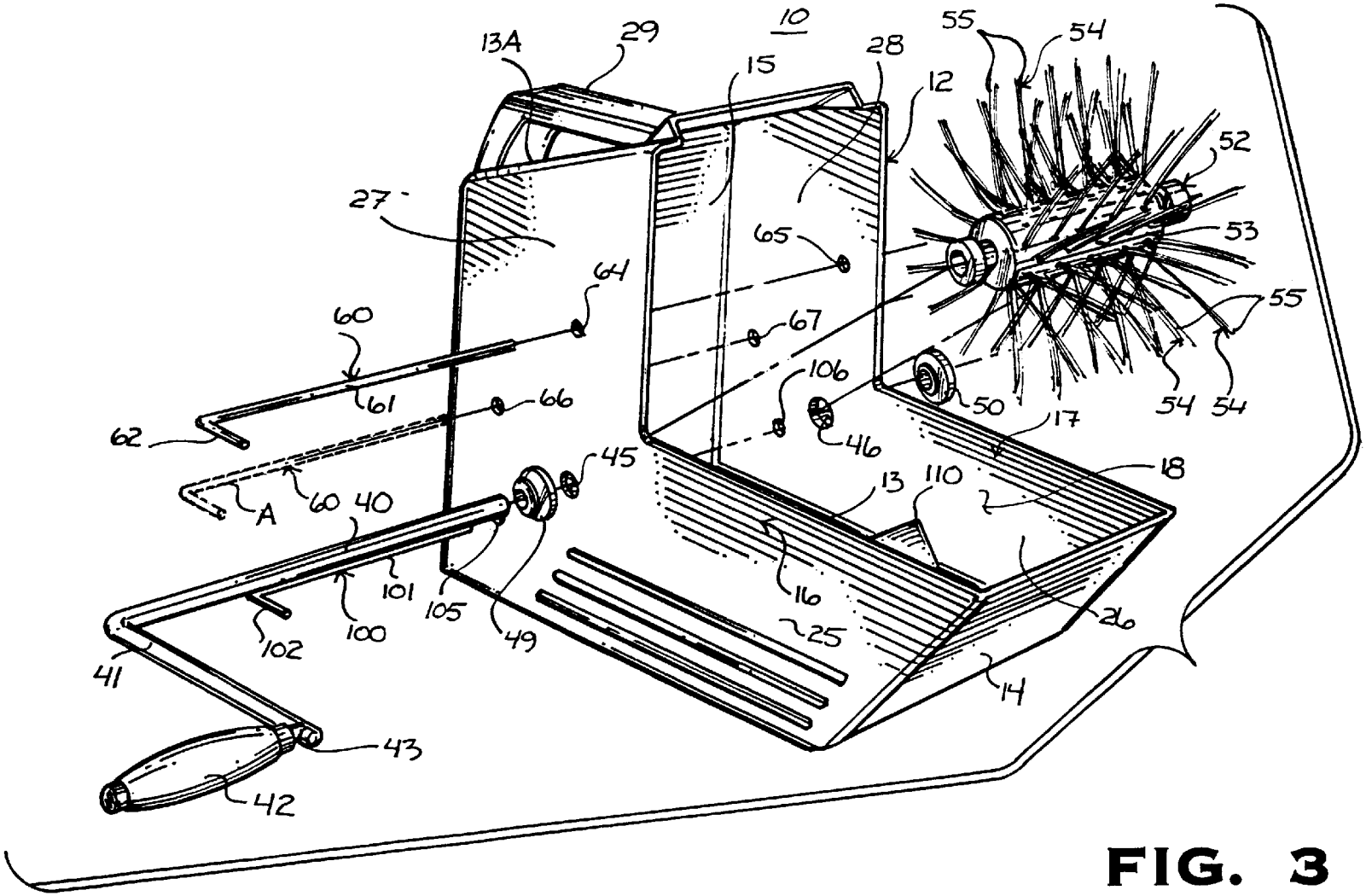
FIG. 3 is an exploded perspective view of the applicator somewhat similar to the view of FIG. 1.

With continuing reference to FIG. 1 and additional reference to FIG. 3, shown are exploded perspective views of applicator 10. Applicator 10 includes a housing 12 having a bottom panel 13 and an upper panel 13A, shown more clearly in FIG. 4. Extending upwardly from bottom 13 is a front wall 14, an end wall 15 further extending upwardly to upper panel 13A, and substantially parallel spaced-apart sidewalls 16 and 17 which are substantially L-shaped to define a spout 18 having a substantially 90 degree opening to permit adjustment of viscous mass impelled therethrough, further details of which will be addressed as the detailed description ensues. Front wall 14 further extends somewhat forwardly further enlarging spout 18. Similarly, upper panel 13A not only extends forwardly from end wall 15 interconnecting sidewalls 16 and 17, but also extends somewhat upwardly further enlarging spout 18. Preferably configured to be a hand held device, as can be seen more clearly in combination with FIGS. 6 and 7, to end wall 15 and upper panel 13A there is a handle 29 coupled at 29A and 29B, respectively, for allowing a user to grasp and support applicator 10 during operation as shown in FIG. 2.

Sidewalls 16 and 17 each include a reservoir portion 25 and 26, respectively, and a shield portion, 27 and 28, respectively. Shield portions 27 and 28, in combination with bottom panel 13, define a reservoir, designated by the reference character 30 in FIGS. 6–9, reservoir 30 for containing a viscous mass 31 shown in FIGS. 7–9. Additionally, as will be further discussed, shield portions 27 and 28, in combination with end wall 15, define a shield generally at 32 for inhibiting a user from being spattered with viscous mass 31 during operation.

Figure 6:
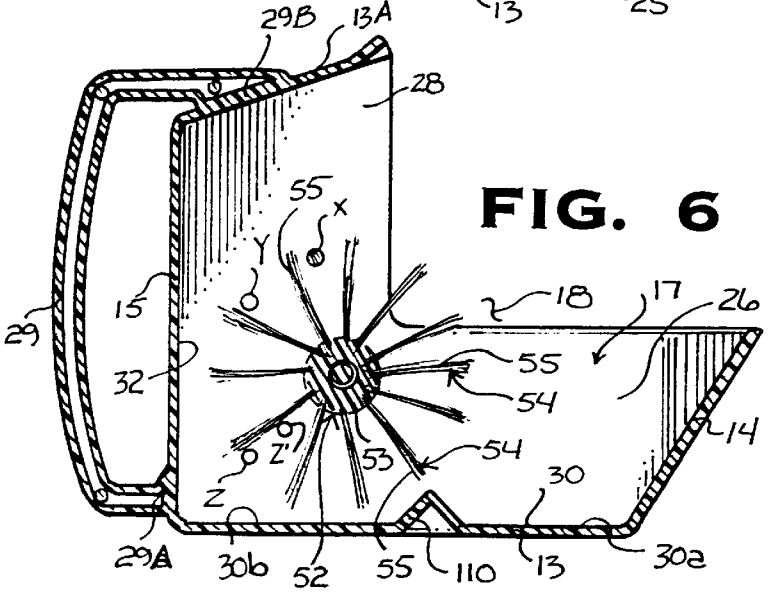
FIG. 6 is a sectional view of the applicator taken along line 6—6 of FIG. 4.
Figure 4:
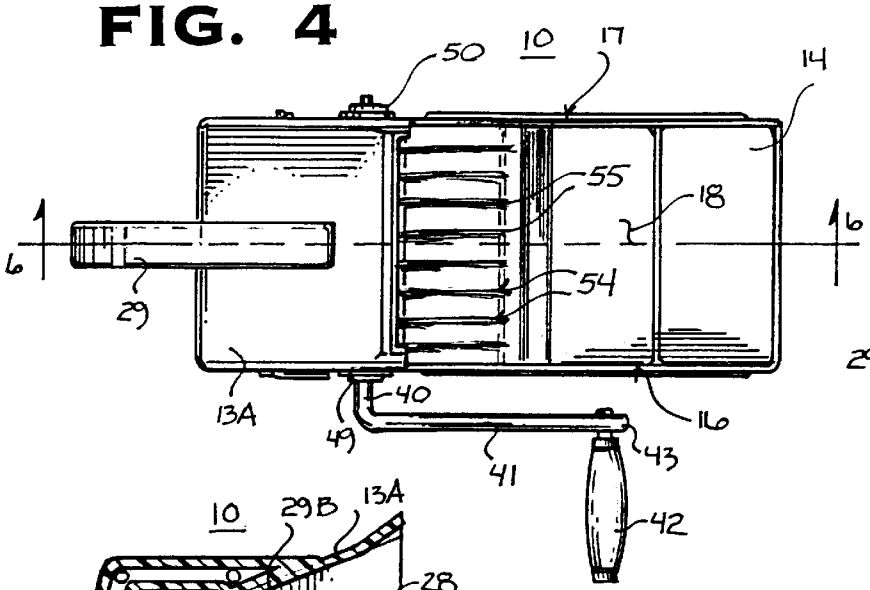
FIG. 4 is a top plan view of the applicator shown in FIG. 2.
Figure 7:
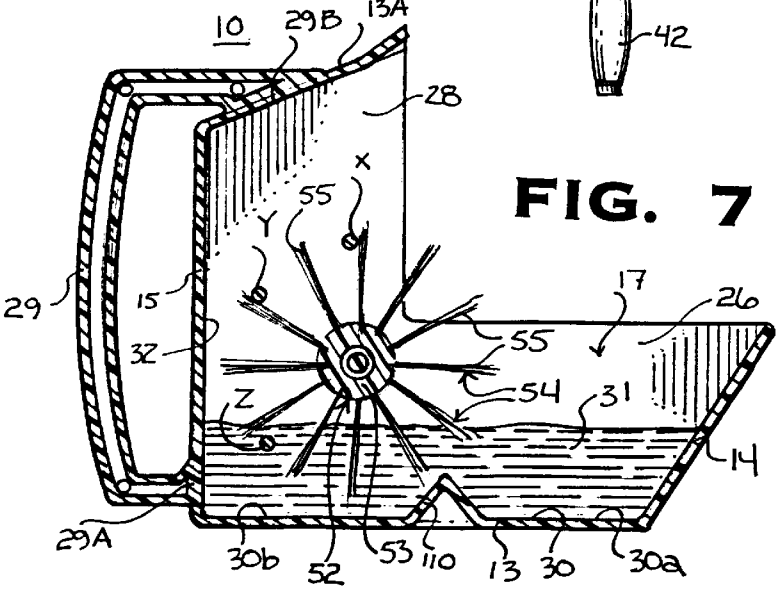
FIG. 7 is a view very similar to the view of FIG. 6, further showing a viscous mass carried therein.

With continuing reference to FIGS. 1 and 3, and additional reference to FIGS. 4, 6, and 7, sidewall 16 and 17 of applicator 10 support a transverse shaft 40 having a crank 41 with a handle 42 coupled proximate an end 43 thereof. As can be seen in FIG. 3, shaft 40 is received through opposed apertures 45 and 46 formed through sidewalls 16 and 17 respective at positions generally where reservoir portions 25 and 26 and shield portions 27 and 28 intersect, apertures 45 and 46 being further aligned to receive shaft 40. Shaft is further supported in bearings 49 and 50 having glands (not shown) for ensuring liquid or fluid-tightness. Mounted on shaft 40 is an impeller 52 comprising a hub 53 including outwardly extending radially disposed progressively spaced-apart substantially flexible elements 54. With respect to the preferred embodiment, flexible elements 54 include tufts of bristles 55 preferably constructed of nylon or other like substantially flexible material, although alternate substantially flexible or springy elements or means may be used such as flexible metal blades or the like. Although not herein specifically shown, tufts of bristles 55 are embedded within hub 53. Impeller 52 is operative as a carrier for collecting and impelling viscous mass 31 through spout 18. However, it will be readily appreciated by those having ordinary skill that other means may be employed without departing from the nature and scope of the instant invention as herein specifically disclosed.

With reference directed back to FIG. 1 and FIG. 3, sidewalls 16 and 17 of applicator 10 further support a transverse abutment 60 having a shaft 61 with a handle 62. Shaft 61 of abutment 60 is received through either opposed apertures 64 and 65, or opposed apertures 66 and 67, formed through sidewalls 16 and 17 respectively. Apertures 62 and 63, being circumferentially disposed relative impeller 52 and further aligned to receive abutment 60, correspond to a first position X (FIG. 6 and FIG. 7) at which abutment 60 may reside, and apertures 64 and 65, which are also circumferentially disposed relative impeller 52 and further aligned to receive abutment 60, correspond to a second position Y (FIG. 6 and FIG. 7) at which abutment 60 may reside, as indicated by dotted outline A of abutment 60. With respect to the preferred embodiment, apertures 64, 65, 66, and 67, are formed generally through shield portions 27 and 28 of sidewalls 16 and 17 respectively.

Figure 8:
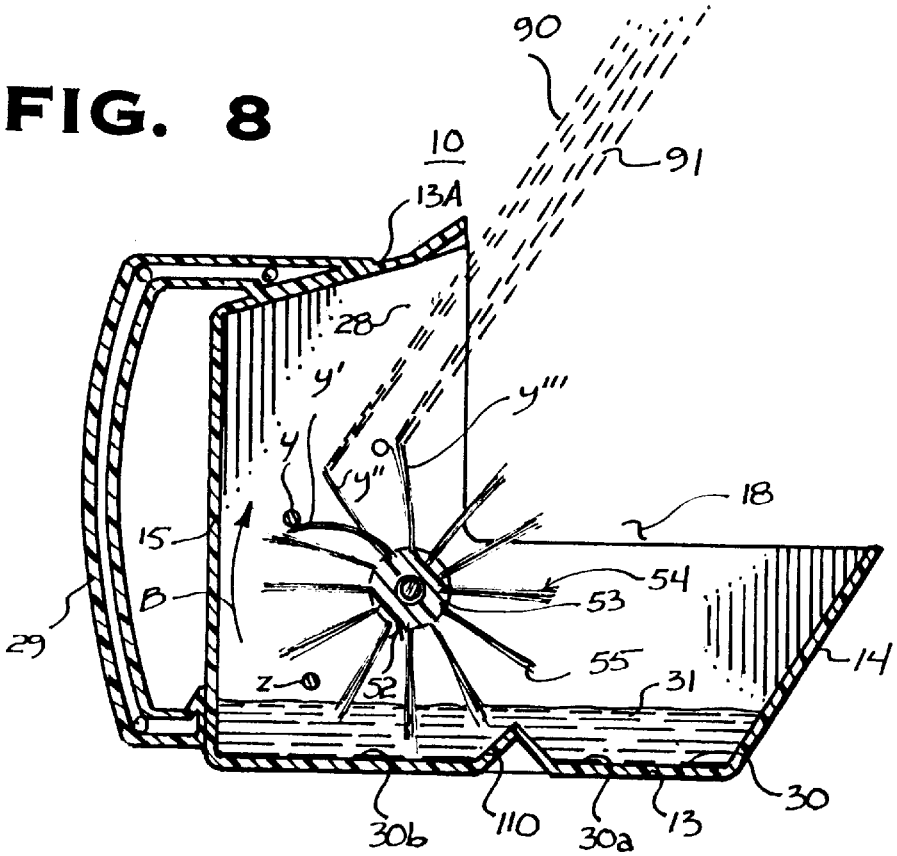
FIG. 8 is a view very similar to the view of FIG. 7, further showing the viscous mass being dispensed in a first trajectory.
Figure 9:
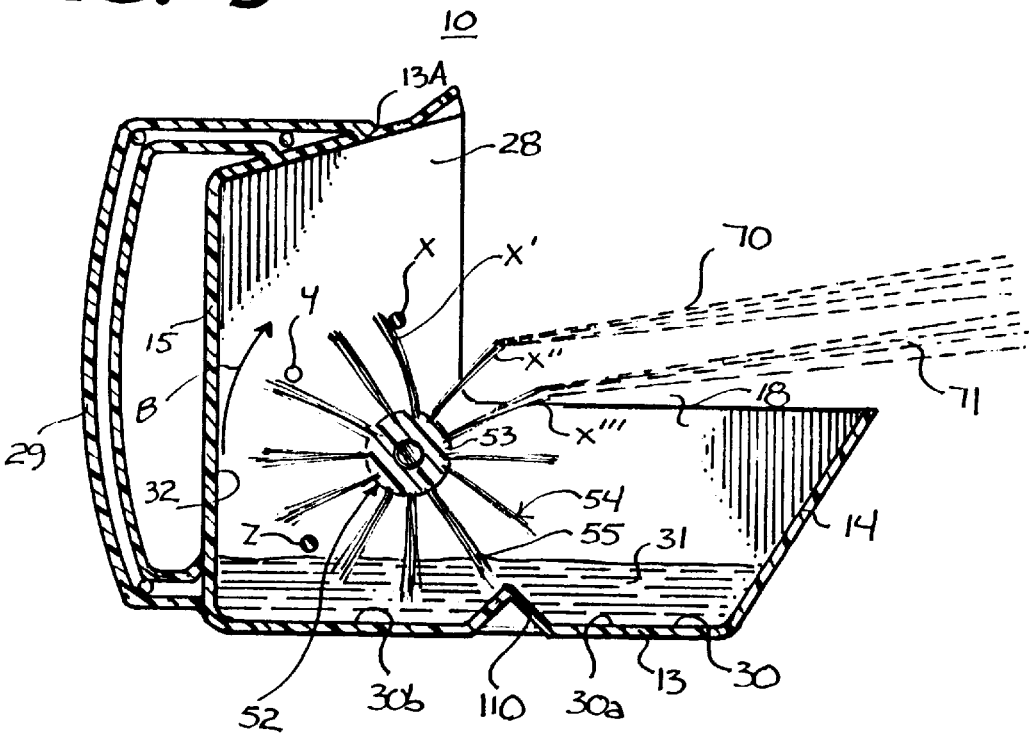
FIG. 9 is a view very similar to the view of FIG. 8 showing the viscous mass being dispensed in a second trajectory.

During operation of applicator 10, as shown in FIG. 2, handle 42 is grasp for rotating impeller 52. Upon rotation of impeller 52 in the direction indicated by arrow B in FIG. 9 and arrow C in FIG. 2, flexible elements 54 pass through reservoir 30 where they pass through and collect viscous mass 31, as best seen in FIGS. 8–9. With respect to the illustration of FIG. 9, abutment 60, although not shown in FIG. 9, is placed at first position X, of which can easily be seen in FIG. 5. Upon further rotation of impeller 52, flexible elements 54 abut against abutment 60 located at first position X at which flexible elements 54 become first bent or agitated into a position at X' and thereafter released to a position indicated by flexible elements 54 at X" and X'", whereby the viscous mass 31 having been collected upon flexible elements 54 is thrown and spattered through spout 18 along paths 70 and 71 for adherence to a surface such as a substantially vertical surface 80 in FIG. 2, paths 70 and 71 corresponding to a first trajectory being a more horizontal trajectory.

With reference to FIG. 8, abutment member 60 (not shown) is located in second position Y. Upon rotation of impeller, 52 as herein discussed, flexible elements 54 abut against abutment 60 located at second position Y at which flexible elements 54 become first bent or agitated into a position at Y' and thereafter released to a position indicated by flexible elements 54 at Y" and Y'", whereby the viscous mass 31 having been collected upon flexible elements 54 is thrown and spattered through spout 18 along paths 90 and 91 for adherence to an elevated substantially horizontal surface such as a ceiling (not shown), paths 90 and 91 corresponding to a second trajectory being a more vertical trajectory.

Although other means may be used for adjusting the trajectory of viscous mass impelled or otherwise spattered, the position of abutment member 60 may be selectively adjusted for adjusting the trajectory of viscous mass 31 to a selected and predetermined trajectory. Thus, consistent with the immediate discussion, abutment 60 may be positioned at least at first position X' and the second position Y' for spattering viscous mass 31 in the first trajectory and the second trajectory respectively. Furthermore, abutment may further be positioned at least at any desirable position between the first position X' and the second position Y' for adjusting the trajectory of viscous mass 31 as selectively desired. Accordingly, it will be understood by those having ordinary skill that additional apertures may be formed through housing 12 for positioning abutment 60 proximate any suitable and desired location depending upon whatever trajectory is desired by the user. As such, applicator 10 may be desirably and comfortably held in a substantially horizontal configuration by a user for spattering masses upon either a substantially vertical surface and a substantially horizontal surface such as a ceiling, without having to tilt applicator 10 in order to achieve a desired trajectory.

Figure 5:
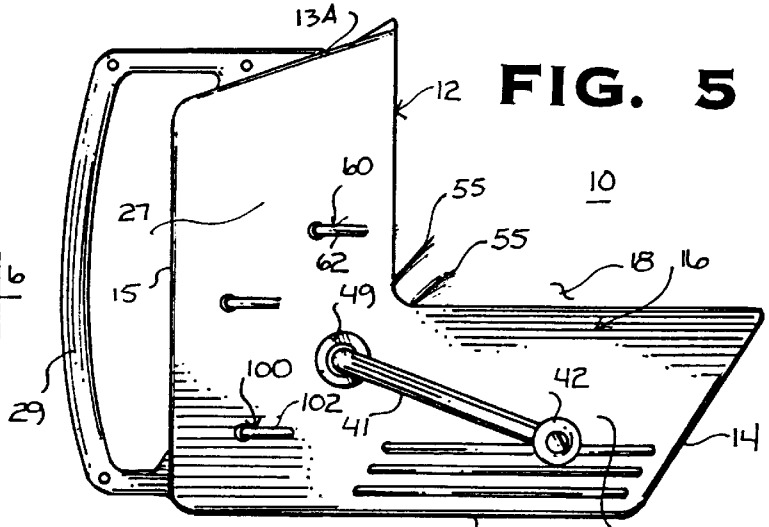
FIG. 5 is a side view of the applicator of FIG. 4.

With attention directed back to FIG. 1 and FIG. 3, further details of the instant invention will now be discussed. In particular, sidewalls 16 and 17 of applicator 10 can further be seen as supporting a transverse wiper abutment 100, which in general similarity to abutment 60, includes a shaft 101 having a handle 102. Shaft 101 is received through opposed apertures 105 and 106 (aperture 106 shown only in FIG. 3) formed through sidewalls 16 and 17 respectively at positions somewhat near but spaced apart from the location where bottom panel 13 and end wall 15 converge. Apertures 105 and 106 are shown circumferentially disposed relative impeller 52. Wiper abutment may be selectively employed in combination with abutment 60 if desired. In particular, when wiper abutment 100 is positioned within apertures 105 and 106 as shown in FIGS. 2 and 5, upon rotation of impeller 52 in the direction indicated by arrow B in FIGS. 8 and 9, flexible elements 54 pass through reservoir 30 where they pass through and collect viscous mass 31. Upon further rotation of impeller 52, flexible elements 54 abut against wiper abutment 100 at which flexible elements 54 become first bent or agitated and thereafter released, whereby some of the viscous mass 31 having been collected upon flexible elements 54 is wiped off or otherwise removed from flexible elements 54. As such, some of the viscous mass 31 may be removed from flexible elements 54 prior to the viscous mass being impelled as herein previously discussed in combination with FIGS. 8 and 9. Therefore, although other means may be used, use of wiper abutment 100 allows a user to control the amount of viscous mass 31 impelled. This is desirable, especially when the amount application of a viscous mass, such as paint, is desired to be regulated or controlled.

With attention directed to FIG. 6, it will be understood that wiper abutment may be selectively radially spaced relative impeller 52 for further controlling the amount of viscous mass 31 impelled through spout 18, such as first position Z shown in FIGS. 6–9, and second position Z' shown only in FIG. 6, first position Z being radially spaced proximate the outer extremities of impeller 52, and second position Z' being radially spaced inwardly towards impeller 52. In first position Z, a first amount of viscous mass 31 is wiped or removed from flexible elements 54, whereas in the second position Z', a second amount of viscous mass 31 is wiped or removed from flexible elements 54, the first amount being less than the second amount.

It will be readily understood by those having ordinary skill, that wiper abutment 100 may be positioned at least at first position Z and second position Z' for removing a selected amount of viscous mass 31 from flexible elements 54 prior to viscous mass 31 being spattered through spout 18. Wiper abutment 100 may further be positioned at least at any desirable position between the first position Z and the second position Z' for adjusting the amount of viscous mass 31 removed. Accordingly, it will be understood by those having ordinary skill that additional apertures may be formed through housing 12 for positioning wiper abutment 100 proximate any suitable and desired location depending upon whatever amount of viscous mass 31 is desired to be removed from flexible elements 54 prior to viscous mass being impelled through spout 18.

For optimum operation, shaft 40, shaft 61, and shaft 101 reside respectively in substantially parallel planes. Furthermore, although housing 12 may be constructed of metal or other similar materials, it is preferred that housing is integrally molded from a substantially rigid and damage resistant plastic. Furthermore, as can be easily seen in FIGS. 3, and 6–9, bottom panel 13 may formed with a baffle 110 for separating reservoir 30 into a forward reservoir **30*a* and a rearward reservoir 30*b*** for aiding a user in regulating masses therein having varying viscosity.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An apparatus for applying a viscous mass to a surface, said apparatus comprising:

a housing having a spout and a reservoir for carrying a viscous mass;

an abutment spaced from said reservoir;

an impeller mounted for rotation adjacent said reservoir and having radially extending substantially flexible impeller elements; and a wiper abutment having first and second ends mounted with said housing spaced from said abutment, said reservoir and said viscous mass, said wiper abutment adjustable between a first radial position relative said impeller and a second radial position relative said impeller;

said substantially flexible impeller elements for passing through and collecting said viscous mass upon rotation of said impeller and for successively engaging said wiper abutment between said first and second ends at one of the first radial position and the second radial position past which said impeller elements are flexed, whereupon release therefrom impel mass particles for receipt into said reservoir to remove a first amount of viscous mass from said impeller elements in said first radial position of said wiper abutment and a second amount of viscous mass from said impeller elements in said second radial position of said wiper abutment, said first amount of viscous mass being different than said second amount of viscous mass, and then for successively engaging said abutment past which said impeller elements are flexed, whereupon release therefrom impel mass particles through said spout against said surface.

2. The apparatus of claim 1, wherein said housing further includes a shield for inhibiting said viscous mass from collecting on a user during use.

3. The apparatus of claim 1, wherein said abutment is movable at least between a first position for impelling said viscous mass in a first trajectory, and a second position for impelling said viscous mass in a second trajectory.

4. The apparatus of claim 3, wherein said abutment is detachably carried by said housing.

5. The apparatus of claim 4, wherein said abutment is circumferentially disposed relative said impeller.

6. The system of claim 1, wherein said wiper abutment is detachably carried by said housing.

7. A method of applying a viscous mass to a surface, said method comprising the steps of:

providing a housing having a spout and a reservoir for carrying a viscous mass;

providing an impeller having radially extending substantially flexible impeller elements;

mounting said impeller for rotation adjacent said reservoir;

providing an abutment carried by said housing spaced from said reservoir;

providing a wiper abutment having first and second ends mounted with said housing spaced from said abutment, said reservoir and said viscous mass, said wiper abutment adjustable between a first radial position relative said impeller and a second radial position relative said impeller;

rotating said impeller for passing said impeller elements through and collecting said viscous mass successively thereon and for successively engaging said wiper abutment between said first and second ends at one of the first radial position and the second radial position past which said impeller elements are flexed, whereupon release therefrom impel mass particles for receipt into said reservoir to remove a first amount of viscous mass from said impeller elements in said first radial position of said wiper abutment and a second amount of viscous mass from said impeller elements in said second radial position of said wiper abutment, said first amount of viscous mass being different than said second amount of viscous mass, and then for successively engaging said abutment past which said impeller elements are flexed, whereupon release therefrom impel mass particles through said spout against said surface.

8. The method of claim 7, further including the step of providing a shield for inhibiting said viscous mass from collecting on a user during use.

* * * * *